US007578404B2

(12) United States Patent
Ekkert

(10) Patent No.: US 7,578,404 B2
(45) Date of Patent: Aug. 25, 2009

(54) TAMPER EVIDENT BAND CLOSURE ASSEMBLY

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 1077 days.

(21) Appl. No.: 11/051,397

(22) Filed: Feb. 4, 2005

(65) Prior Publication Data

US 2006/0175281 A1 Aug. 10, 2006

(51) Int. Cl.
*B65D 41/32* (2006.01)
*B65D 49/12* (2006.01)
*B65D 17/32* (2006.01)

(52) U.S. Cl. ..... 215/252; 215/258; 220/268

(58) Field of Classification Search ..... 215/254, 215/250, 258, 322, 44, 43, 901, 346, 341, 215/316, 200; 220/268, 265, 301, 298, 260
See application file for complete search history.

(56) References Cited

U.S. PATENT DOCUMENTS 4,126,240 A * 11/1978 Brach ..... 215/252
4,401,227 A * 8/1983 Pehr ..... 215/252
4,506,795 A * 3/1985 Herr ..... 215/252
4,511,054 A * 4/1985 Shank ..... 215/252
5,007,545 A * 4/1991 Imbery, Jr. ..... 215/14
5,398,829 A * 3/1995 Stubbs ..... 215/256
5,450,972 A * 9/1995 Zemlo ..... 215/252
5,755,346 A * 5/1998 Ekkert ..... 215/252
6,325,227 B1 * 12/2001 Ekkert ..... 215/252
2001/0015341 A1 * 8/2001 Higgins ..... 215/252
2005/0061766 A1 * 3/2005 Jochem ..... 215/305
2005/0252878 A1 * 11/2005 Babcock ..... 215/252

* cited by examiner

*Primary Examiner*—Anthony D Stashick
*Assistant Examiner*—Robert J Hicks
(74) *Attorney, Agent, or Firm*—Husch Blackwell Sanders LLP Welsh & Katz

(57) ABSTRACT

A two-piece closure and tamper evident band assembly for use with a container neck having a peripheral bead is shown. The closure includes a top having a depending skirt. The skirt includes a break-away band frangibly connected to a bottom periphery of the skirt. The tamper evident band includes means for tearing and a lower ledge extending from a lower periphery of the band. The break-away band is positioned above the lower ledge. The closure and tamper evident band assembly is inserted onto the container neck, and when the closure is removed, the peripheral bead prevents the lower ledge and the tamper evident band from moving upward. As the closure moves up the container neck, the means for tearing tears the frangible connectors so that the break-away band and the tamper evident band remain positioned on the container.

26 Claims, 6 Drawing Sheets

TAMPER EVIDENT BAND CLOSURE ASSEMBLY

BACKGROUND OF THE INVENTION

The present invention relates to a tamper evident band closure assembly for use with a container having a peripheral bead.

Tamper-indicating or tamper-evident closures have become common-place in consumer markets. Typically, a threaded container includes an annular bead, or like annular projection extending from the container finish, adjacent to and below the container threaded portion. The closures are typically a unitary piece and include a cap and a depending tamper-indicating skirt that separates from the cap upon initial removal of the closure from the container.

Consumers will readily recognize that such one-piece closures are used for sealing containers of all types, including milk containers, juice containers, soft drink containers and the like. Those skilled in the art will recognize that such containers can have various sizes of openings and thus various sizes of closure caps. The container opening sizes may be dependent upon, in part, the liquid stored in the container. For example, some types of liquid foods may be best packaged in a container that has a relatively small dispensing opening that provides for directed pouring, while others liquids, such as milk, juice and the like, that are consumed directly from the container may be best packaged in containers having a relatively large dispensing opening.

A typical closure that is fitted to the container includes a plastic closure having a circular top and a depending annular skirt portion. The skirt portion has an internal thread configured to threadedly engage the container thread. A tamper evident band for providing tamper indication is provided by a separable band that extends and depends from the skirt portion. The band engages the skirt and separates from the skirt portion as the closure is removed from the container.

The band typically includes bridge-like connectors that extend between the skirt portion and the band. The connectors are designed and formed to break as the closure is initially removed from the container. Thus, after the closure is removed from the container, the tamper evident band remains on the container neck, warning subsequent users that the closure has been tampered with. Exemplary of such a closure is that disclosed in U.S. Pat. No. 5,450,972 to Zemlo, which is incorporated herein by reference.

Although the one-piece closures function well to inform subsequent users that the container has been tampered with, the closures are still encumbered by many shortcomings. For example, when the closures are fitted onto the containers, the tamper evident bands are typically forced over the annular bead of the container neck, causing the tamper evident band to stretch over the bead. If the band stretches beyond a certain limit, the band may deform, causing the tamper evident band to over-expand and slip over the annular bead when the closure is removed from the container. As a result, the tamper evident band will also be removed, and subsequent users of the container will not know whether the container has been tampered with or not—destroying the very purpose of the tamper evident band.

Further, one-piece closures that have a frangibly connected tamper evident band are difficult to mold. Specifically, when larger containers are used to store more liquid, the container opening is typically larger, requiring larger diameter closures. When one-piece tamper evident band closures are molded in larger sizes, additional metallic slides and pieces must be added to the mold to properly form the closure. The slides and metallic pieces, however, occupy additional space in the mold. As a result, fewer closures may be manufactured during each molding operation.

Accordingly, there exists a need for an improved closure having a tamper evident band that addresses the shortcomings of present closures.

BRIEF SUMMARY OF THE INVENTION

The present invention pertains to closure and tamper evident band assemblies for use with a container neck having a peripheral bead. One embodiment includes a two piece tamper evident band closure assembly. The closure includes a top having a skirt depending from a top periphery. The skirt includes a break-away band frangibly connected to a bottom periphery of the skirt by either a web or a plurality of frangible connectors or bridges. The tamper evident band includes a means for tearing, which, in one embodiment, comprises a plurality of upper lips and, in another, comprises a continuous upper lip—either of which extends from a top periphery of the tamper evident band. The tamper evident band also includes a lower ledge extending from a lower periphery of the tamper evident band. The break-away band of the closure is positioned between the upper lip(s) and lower ledge of the tamper evident band so that the closure and the tamper evident band cooperate with one another.

In another embodiment, a staying ring extends from the lower ledge. After the closure is positioned onto the neck and when one removes the closure from the neck, the peripheral bead prevents upward movement of the tamper evident band. Specifically, the staying ring is defined by an inner dimension that is less than a corresponding outer dimension of the peripheral bead. When a user attempts to remove the closure, the peripheral bead prevents the staying ring and, thus, the tamper evident band from moving upward. As the closure moves around and up the container neck, the means for tearing and, in other embodiments, the upper lip(s) tear the frangible connectors so that the closure is removed and the break-away band breaks away from the closure and remains positioned on the container. In one embodiment, the break-away band remains positioned between the upper lips and the lower ledge.

In alternate embodiments, the closure and tamper evident band are snap-on assemblies that are pulled off, instead of being twisted off. In yet other alternate embodiments, the closure, tamper evident band and container assemblies can be defined by various shapes, such as, square, oval and the like.

Because the assembly is comprised of two separate pieces, larger diameter assemblies may be molded without the use of slides or other additional pieces in the mold. As a result, a larger number of assemblies may be manufactured during one molding operation. Manufacturing efficiency, therefore, is enhanced and costs are reduced.

In yet another embodiment, the lower ledge includes a crevice or an upside-down v-shaped opening formed on a bottom surface of the lower ledge. When the tamper evident band closure assembly is inserted onto a container neck, the crevice compresses and then expands (or biases inward and then outward) to facilitate tamper evident band insertion, e.g., the capping operation. The biasing also reduces tamper evident band stretching during the insertion process, thus reducing the risk of tamper evident band deformation and stretching when a user attempts to remove the closure from the container.

In an alternate embodiment, the closure and tamper evident band are frangibly connected by frangible connectors to form a one-piece closure. The tamper evident band includes a lower ledge having a crevice formed on its lower surface and an inner dimension that is smaller than a corresponding outer dimension of a peripheral bead of the container. When the closure is inserted onto the container neck and over the peripheral bead, the crevice biases inward and then outward to facilitate the capping operation. When the closure is removed from the container neck, the peripheral bead prevents the lower ledge from moving upward, and as the closure moves upward and around the container neck, the frangible connectors break. The closure is then removed from the container neck, and the tamper evident band remains on the neck.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
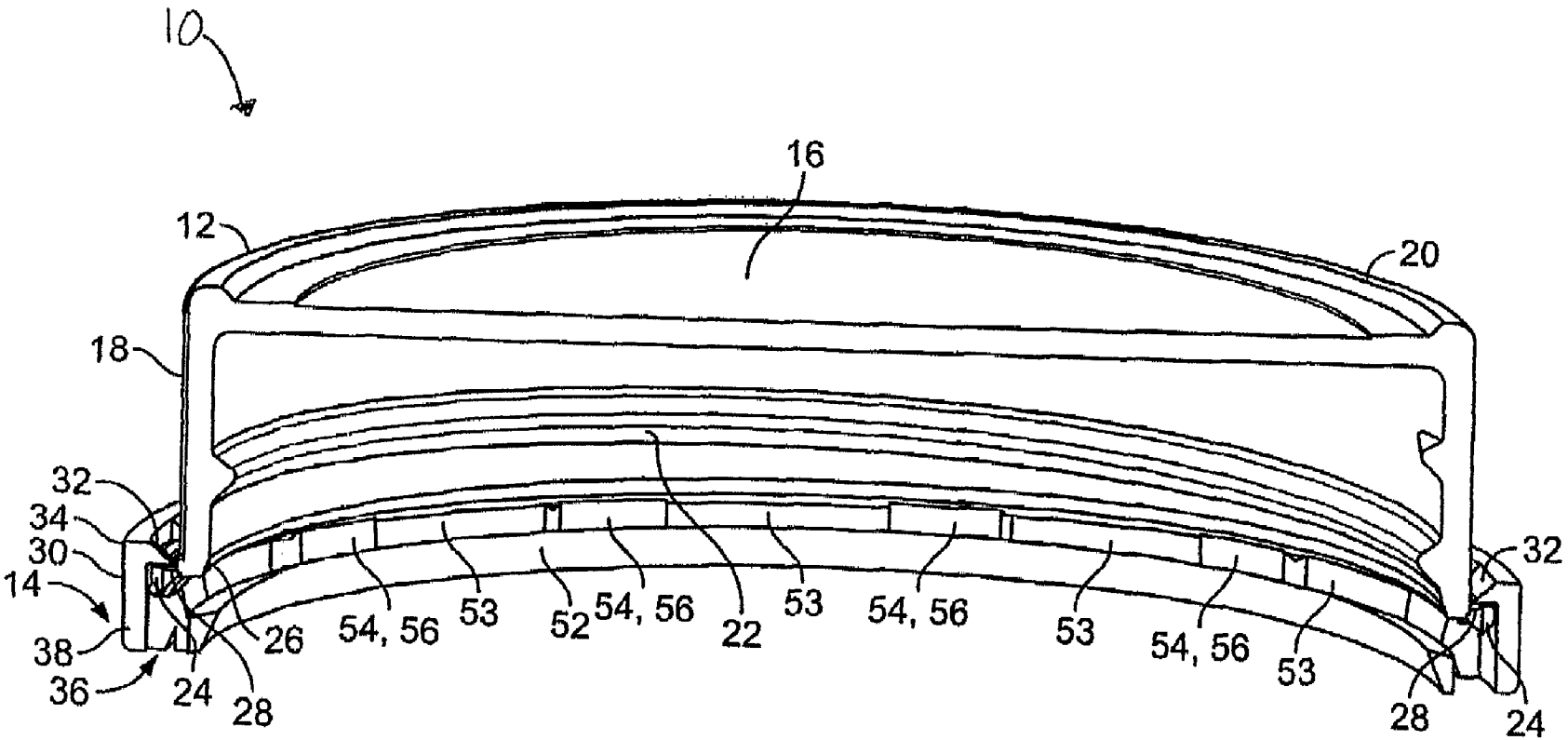
FIG. 1 is a cut away view of a two-piece closure assembly of the invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

One embodiment of the invention includes a two-piece tamper evident band closure assembly. The closure includes a top having a skirt that depends from a periphery of the top. The skirt includes a break-away band that is frangibly connected to a bottom periphery of the skirt by a plurality of frangible connectors. According to a first aspect of the invention, the tamper evident band includes a means for tearing the frangible connectors. In one embodiment, the means for tearing comprises an upper lip, which comprises a continuous upper lip in one embodiment and, in another embodiment, comprises a plurality of upper lips spaced from one another. Preferably, the means for tearing extends from a top periphery of the tamper evident band. The tamper evident band also includes a lower ledge that extends from a bottom periphery thereof. In one embodiment, the break-away band of the closure is positioned between the upper lip(s) and the lower ledge of the tamper evident band so that the tamper evident band and the closure cooperate with one another.

In a specific embodiment, when the closure is positioned onto the associated neck, the lower ledge is positioned below the peripheral bead and is defined by an inner dimension that is smaller than a corresponding outer dimension of the peripheral bead. Thus, when the closure is turned to remove the closure from the associated container, the closure moves upward, the peripheral bead prevents the lower ledge and the tamper evident band from moving upward, and the means for tearing tears the frangible connectors so that the break-away band breaks away from the closure and remains positioned on the associated container. In one embodiment, the break-away band remains positioned between the upper lip(s) and lower ledge.

In alternate embodiments, instead of being turned or twisted off, the closure is a snap-on closure that is pulled off of the container. Thus, when an upward force is applied to the closure to pull it off of the container, the peripheral bead prevents the lower ledge and the tamper evident band from moving upward, and the means for tearing tears the frangible connectors so that the break-away band breaks away from the closure.

In yet other embodiments, the closure, tamper evident band, and container may have a variety of shapes, such as a square, an oval and the like. Thus, as used herein, "band" shall mean a strip that has a shape. For example, when the closure and container have square shapes, the tamper evident band, likewise, has a square shape; likewise, when the closure and container are circular, so too is the tamper evident band.

As a result, embodiments incorporating the first aspect of the invention provide for a closure that leaves a tamper evident band behind when the top is removed from the container. In addition, because the tamper evident band and the closure are comprised of two separate pieces, they are easier to mold and allow for more closure-tamper evident band assemblies to be molded during a singe molding operation.

In embodiments incorporating a second aspect of the invention, the lower ledge further comprises a staying ring that extends from the lower ledge. In one embodiment, the lower ledge is continuous, and in another, the lower ledge includes breaks formed therein so that there are a plurality of discrete lower ledge portions. The tamper evident band further includes a plurality of lower tabs, each having the discrete lower ledge portions. The staying ring extends from the lower tabs. The peripheral bead of the neck is defined by a larger outer dimension than a corresponding inner dimension of the staying ring and prevents the tamper evident band from being removed from the container.

As used herein, the term "ring" shall mean a strip that has a shape. For example, when the closure and container have square shapes, the staying ring, likewise, has a square shape; likewise, when the closure and container are circular, so too is the staying ring.

In embodiments incorporating a third aspect of the invention, the lower ledge includes a crevice or an upside-down v-shaped opening formed therein. When the tamper evident band is slid onto the container neck and over the peripheral bead, the crevice biases inward and then outward to facilitate the capping operation, i.e., inserting the closure onto the container. The biasing also reduces the amount the tamper evident band stretches and reduce the risk of band deformation. As a result, there is a reduced risk of the tamper evident band inadvertently overstretching and slipping over the peripheral band when the closure is removed. Embodiments incorporating the third aspect of the invention may comprise a one-piece closure with the tamper evident band being integral with the skirt, or may comprise a two-piece closure assembly.

FIG. 1 shows a two-piece closure and tamper evident band embodiment 10 incorporating the first, second and third aspects of the invention. The closure 12 cooperates with the tamper evident band 14 and includes a top 16. The top 16 includes a skirt 18 that depends from a periphery 20 of the top 16 and that includes threading 22 formed on an inner surface thereof. The closure includes a break-away band 24 that is coupled to a bottom periphery 26 of the skirt 18 by a plurality of frangible connectors or bridges 28. The frangible connectors 28 can either extend laterally or depend from the bottom periphery 26 of the skirt 18, and the break-away band 24 can either depend or extend laterally from the frangible connectors. Note that in other embodiments incorporating a snap-on type closure (not shown), the skirt need not have threading formed on its inner surface.

Figure 2:
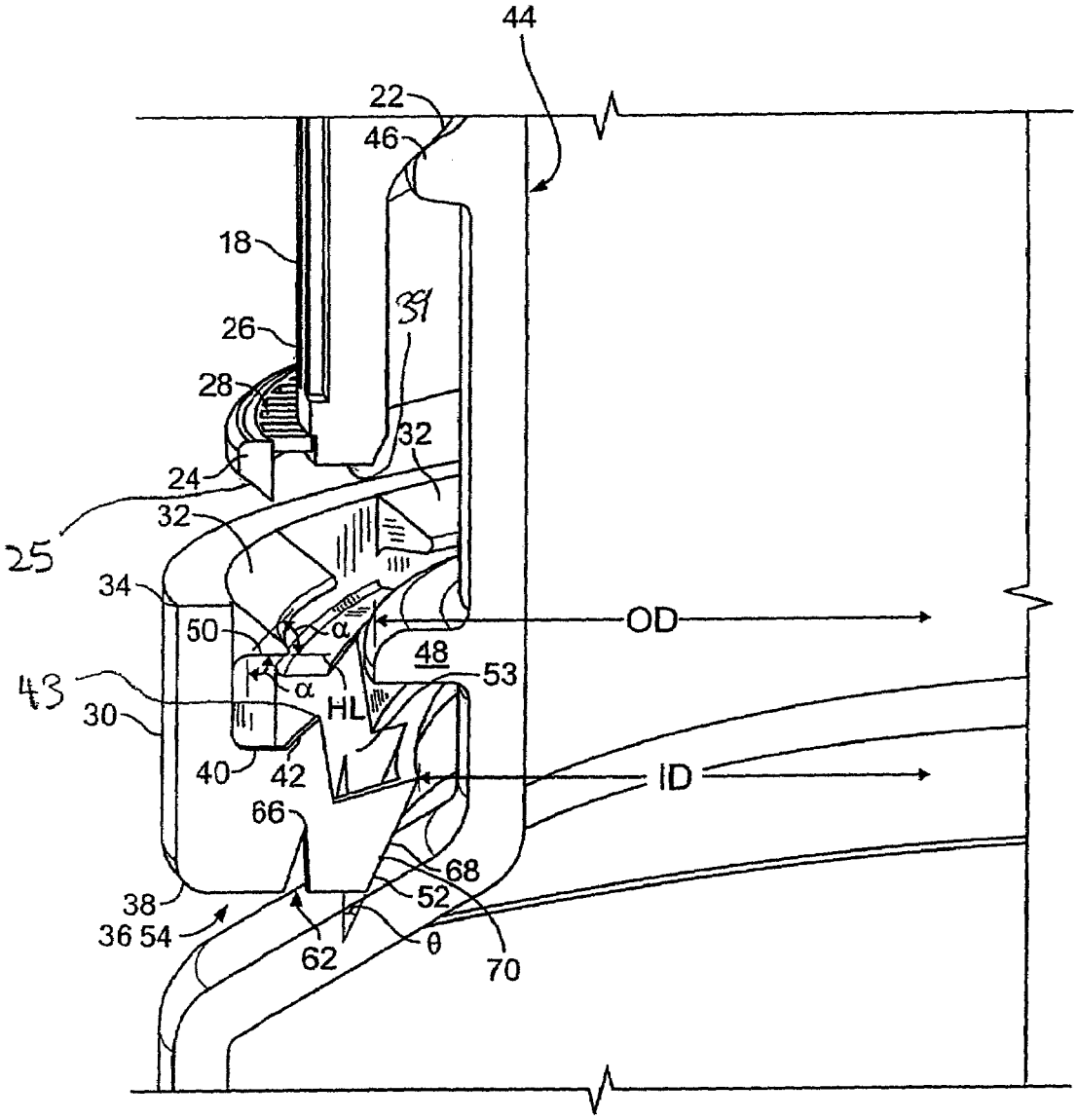
FIG. 2 is cut-away and exploded view of a closure of the invention cooperating with a tamper evident band of the invention that is positioned on a container.
Figure 3:
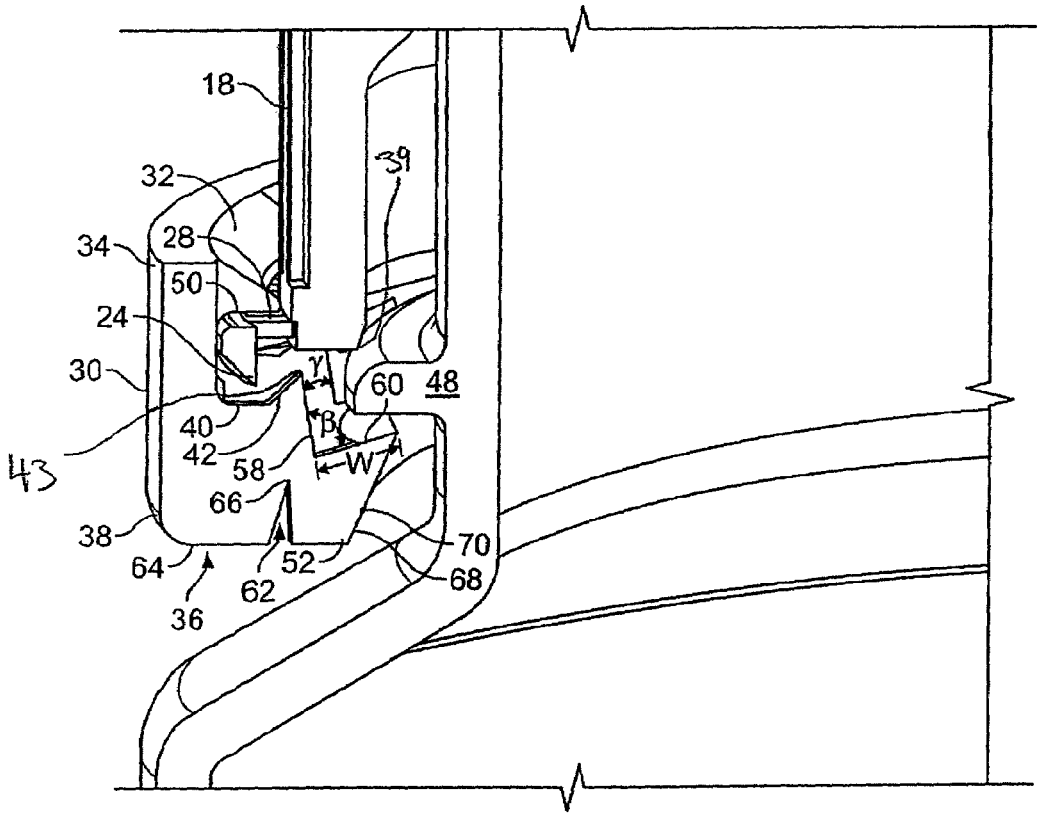
FIG. 3 is a cut-away and enlarged view of a closure cooperating with a tamper evident band to form a two-piece closure assembly of the invention that is positioned on a container.
Figure 4:
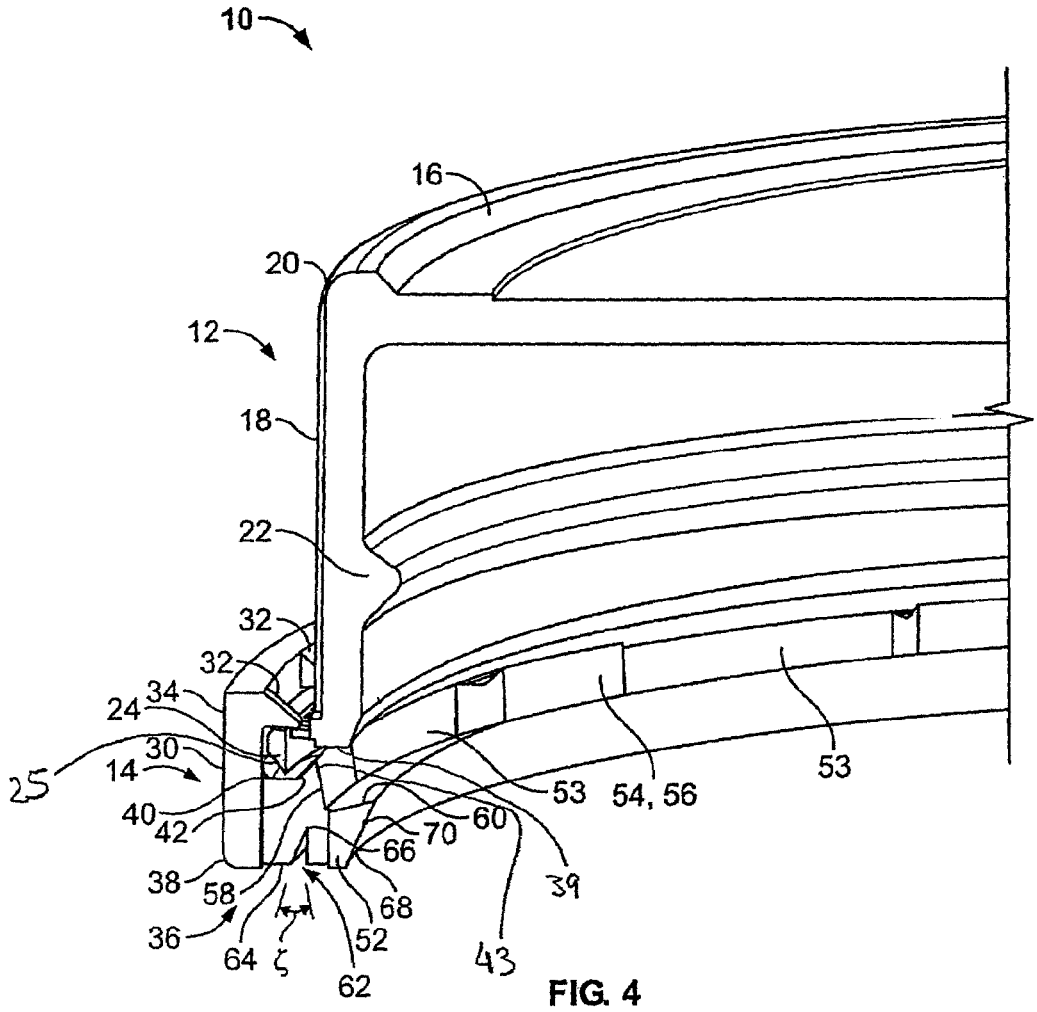
FIG. 4 is an enlarged view of a closure cooperating with a tamper evident band to form a two-piece closure assembly of the invention.

The tamper evident band 14 includes a means for tearing the frangible connectors. In the embodiment shown in FIGS. 1 and 2, the means for tearing comprises a plurality of upper lips 32 extending from and spaced around a top periphery 34 of the tamper evident band. In other embodiments, the means for tearing may comprise a continuous upper lip. A lower ledge 36 also extends from a bottom periphery 38 of the tamper evident band 14. Preferably, as shown in the embodiment of FIGS. 1 and 2, the lower ledge 36 includes a top surface 40 and an angled portion 42 adjacent to the top surface. In the embodiments shown in FIGS. 1-5, the angled portion 42 includes an apex 43. The closure 12 cooperates with the tamper evident band 14 by having the break-away band 24 positioned between the upper lips 32 and the top surface 40 of the lower ledge 36, as shown in FIGS. 3-4. Specifically, the break-away band 24 includes a bottom surface 25 that sits atop the top surface 40 of the lower ledge 36; and, the skirt 18 includes a skirt bottom surface 39 that sits atop the apex 43. The angled portion 42 of the lower ledge 36 reduces lateral movement of the break-away band 24 within the tamper evident band 14.

The tamper evident band closure assembly 10 is then screwed or slid onto the container neck 44 so that the internal threading 22 of the skirt 18 and a threading 46 formed on the container neck (FIGS. 2 and 3) cooperate with one another. The lower ledge 36 is defined by an inner dimension ID that is less than an outer dimension OD of a peripheral bead 48 on the container neck. Thus, when the closure assembly 10 is inserted onto the neck 44, the lower ledge 36 slips over and beneath the peripheral bead 48, as shown in FIG. 3. Note that in other embodiments incorporating a snap-on type closure (not shown), the container neck need not have threading.

When a user desires to remove the closure 12 from the container neck 44 of the container (not shown), the user may turn the closure so that it moves laterally around and up the container neck. The peripheral bead 48 keeps the tamper evident band 14 from moving upward. As the closure 12 is moving up the neck 44, the means for tearing (and, in FIGS. 1-5, upper lips 32) of the tamper evident band 14 stays stationary and tears the frangible connectors 28 connecting the break-away band 24 to the skirt 18. Note that, in snap-on type embodiments, the user applies an upward force to the closure to pull it off of the container. The peripheral bead keeps the tamper evident band from moving upward, and as the closure moves up the neck, the means for tearing stays stationary and tears the frangible connectors.

Thus, even after the closure 12 is removed, the break away band 24 remains positioned on the container. In other embodiments, the break-away band 24 remains positioned between the upper lips 32 and the lower ledge 36.

As illustrated in FIG. 2, a bottom surface 50 of the upper lips 32 forms an angle $\alpha$ with a horizontal line HL that is preferably between about −45° and about 45° to allow for effective tearing of the frangible connectors 28. In a most preferred embodiment, the angle $\alpha$ is between about 5° and about 45°, or between about −5° and about −45°.

As shown in FIGS. 1 and 3, the upper lips 32 preferably touch and mate with the frangible connectors 28 or a top portion of the break-away band 24 to facilitate tearing of the frangible connectors upon removal of the closure 12 from the container. In other embodiments, however, the upper lips need not mate with the frangible connectors or top portions of the break-away band, and tearing may still be effectuated upon removal of the closure from the container.

Figure 5:
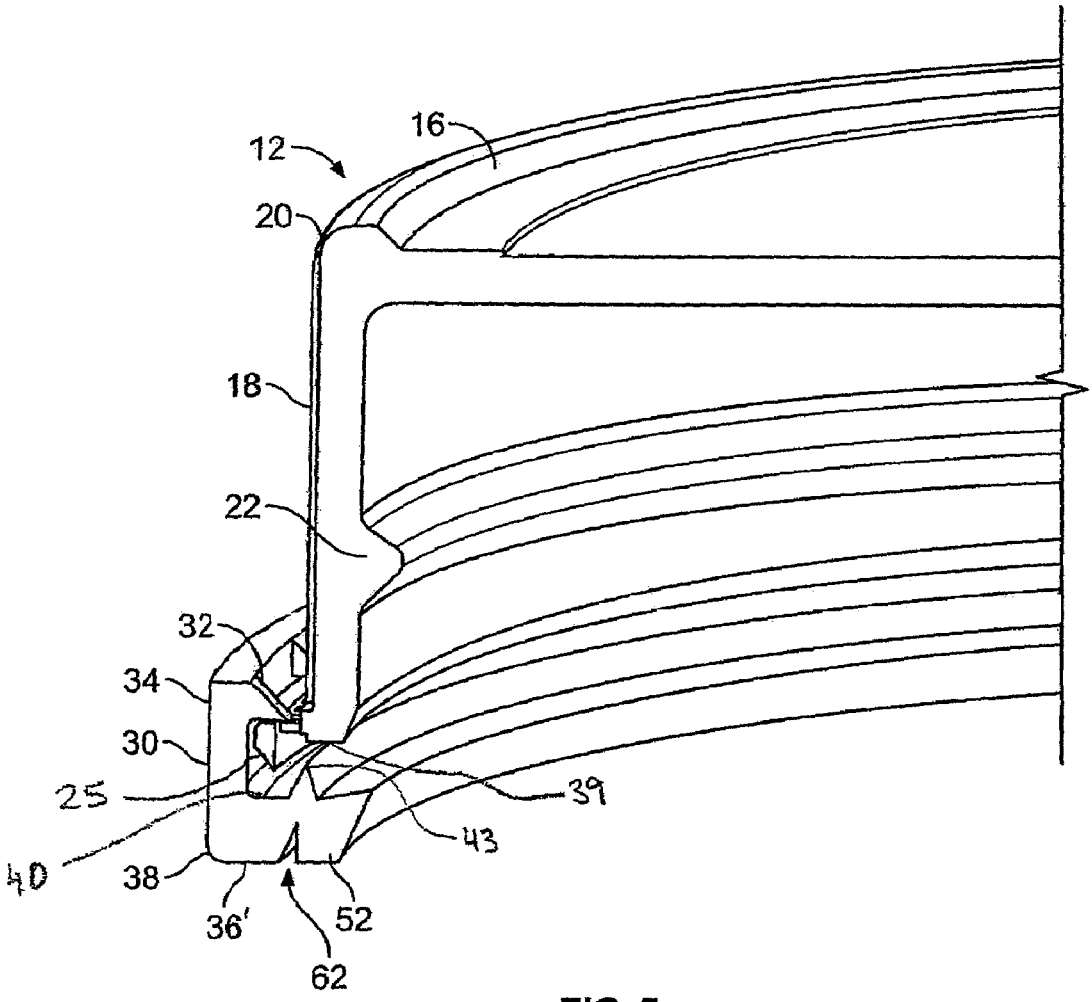
FIG. 5 is a cut-away view of an alternate embodiment of a closure assembly of the invention incorporating a continuous lower ledge; and, FIG. 6 is a cut-away view of an alternate embodiment of a closure assembly of the invention incorporating an angled portion spaced from a vertically extending wall by an intermediate portion.

Pursuant to as second aspect of the invention, as shown in FIGS. 2-4, a staying ring 52 preferably extends from the lower ledge 36. As shown in the embodiment of FIG. 5, the lower ledge 36' may be a continuous ledge; or, as shown in the embodiment of FIGS. 1-4, the lower ledge 36 desirably includes several breaks 53 formed therein so that the lower ledge includes a plurality of discrete lower ledge portions 54. The lower ledge breaks 53 are preferably positioned below the upper lips 32 and facilitate molding of the tamper evident band 14. In the embodiment of FIGS. 1-4, the tamper evident band 14 includes a plurality of lower tabs 56, each including a lower ledge portion 54 and an extending vertical wall 58 that is adjacent to the angled portions 42 and the top surface 40 of the lower ledge 36.

The staying ring 52 preferably extends laterally inward from the lower tabs 56, and in the embodiment of FIG. 5, from the continuous lower ledge 36'. The staying ring 56 is continuous and includes an inner dimension ID that is smaller than the corresponding outer dimension OD of the peripheral bead 48. Thus, when the closure is removed, the peripheral bead 48 prevents the staying ring 52 and the tamper evident band 14 from moving upward. A top surface 60 of the staying ring 52 forms an angle $\beta$ with the vertically extending wall 58, as shown in FIG. 3. To improve contact between the staying ring 52 with the peripheral bead 48 and prevent upward movement of the tamper evident band 14, the angle $\beta$ is preferably less than about 90°. The vertically extending wall 58 may be vertically up or down or may form an angle $\gamma$ that is less than about 10° with a line that is orthogonal OL to a 0° line.

In one embodiment, the top surface 60 of the staying ring 52 forms an angle with a bottom surface of the peripheral bead 48 when the tamper evident band 14 is in a resting position, i.e., when the closure 12 is not being removed from the container neck 44. When the closure 12 is removed from the container neck 44, the tamper evident band 14 moves slightly upward. After a certain point, the peripheral bead 48 prevents the staying ring 52 from further upward movement, and the top surface 60 of the staying ring 52 is pressed up against the peripheral bead 48 so that the top surface of the staying ring and the bottom surface of the peripheral bead are co-planar. The co-planar mating arrangement facilitates prevention of the tamper evident band 14 from moving further upward. Note that, in other embodiments, the top surface may be co-planar with the bottom surface of the peripheral bead in resting positions as well.

The width W of the staying ring 52 is large enough to prevent tamper evident band 14 upward movement and typically depends on factors such as the size of the peripheral bead 48 and the diameter of the container neck 44.

Those of skill in the art will appreciate that the spirit and scope of the invention encompasses several variations of ways to keep the tamper evident band on the container neck when the closure is removed. For example, there may be a continuous lower ledge having an extending protrusion. The extending protrusion may comprise a continuous staying-ring or may comprise a plurality of discrete extending protrusions having a plurality of extending protrusion gaps therebetween. The extending protrusion, whether comprising a continuous staying ring or a plurality of discrete extending protrusions, is defined by an inner dimension that is less than the corresponding outer dimension of the peripheral bead.

In yet other embodiments, there maybe a plurality of lower tabs, each having a plurality of discrete extending protrusions and a plurality of extending protrusion gaps therebetween. The extending protrusion gaps and the lower ledge breaks between the lower tabs are preferably aligned. The plurality of extending protrusions are defined by an inner dimension that is less than the corresponding outer dimension of the peripheral bead. The peripheral bead prevents the extending protrusions or staying ring from moving upward when the closure is removed from the closure.

Figure 6:
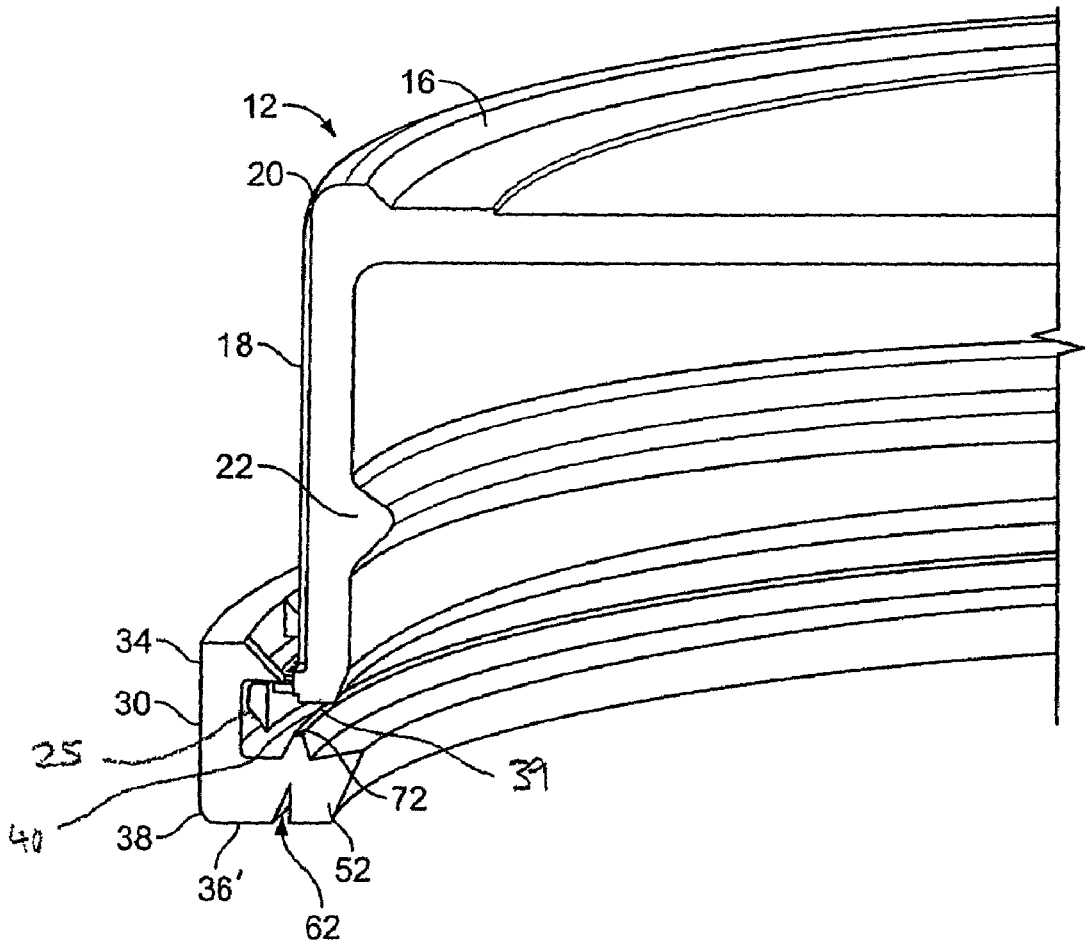

FIGS. 1-5 show that the angled portion 42 and vertically extending wall 58 abutting one another and meet to form a peak. In other embodiments shown in FIG. 6, the angled portion 42 is spaced from the vertically extending wall 58 by an intermediate portion 72, which is flat. In other embodiments not shown, the intermediate portion may be radiused or dome like or have other shapes.

The embodiments shown in FIGS. 1-6 also incorporate a third aspect of the invention, a crevice 62. The crevice 62 is formed on a bottom surface 64 of the lower ledge 36 so that, when the closure and tamper evident band 30 are inserted onto the container neck 44, the crevice compresses and expands, or biases inward and then outward, when the tamper evident band 14 is slid over the peripheral bead 48.

Specifically, the crevice comprises a flex point 66 at its apex, and the staying ring 52 includes a contacting surface 68 having a fulcrum point 70 at its half-way point. In other alternate embodiments incorporating discrete extending protrusions, there is a fulcrum point on the contacting surface of each discrete extending protrusion. When the closure 12 is being slid onto the container, the contacting surface 68 is in contact with the peripheral bead 48 and the crevice 62 compresses or biases inward about the flex point 66, until the fulcrum point 70 contacts the peripheral bead. When the contacting surface 68 is slid beyond where the fulcrum point 70 contacts the peripheral bead 48, the crevice 62 expands or biases outward about the flex point 66. The contacting surface forms an angle θ with a vertical line, and to promote optimal capping operations, the angle θ is less than 90°.

In the preferred embodiment shown in FIGS. 1-4, the crevice 62 is utilized in embodiments incorporating a lower ledge 36 having lower ledge breaks 53. The lower ledge breaks 53 promote greater flexibility in the tamper evident band 14.

As a result, it is easier to insert the tamper evident band 14 onto the container neck 44. Further, the amount the tamper evident band 14 stretches and deforms when the tamper evident band is inserted onto the neck 44 is reduced. The reduced deforming and stretching lowers the risk of the tamper evident band 30 undesirably deforming and sliding over the peripheral bead 48 when the closure 12 is removed. Preferably, to facilitate optimal biasing, the crevice is defined by an angle ξ that is between about 5° and about 10°, as shown in FIG. 4.

As shown in FIGS. 1-6, the crevice may be formed on embodiments having a continuous lower ledge or those having lower ledge breaks and tabs that include discrete lower ledge portions. Those of skill in the art will also appreciate that the crevice may be incorporated on other one-piece closure tamper evident band pieces in which the closure is integrally connected to the tamper evident band by frangible connectors.

From the foregoing it will be observed that numerous modifications and variations can be made to the invention without departing from the true spirit and scope of the novel concepts of the present invention. It is to be understood that no limitation with respect to the specific embodiments illustrated is intended or to be inferred. The disclosure is intended to cover all such modifications as fall within the scope of the invention.

What is claimed is:

1. A closure assembly having a first part and a second part for positioning onto an associated container having a peripheral bead on a neck of the associated container, the assembly comprising:

the first part comprising a closure including a top and a skirt depending from a periphery of the top, the skirt including a break-away band frangibly connected to a bottom periphery of the skirt; and, the second part comprising a tamper evident band separate from the closure, the tamper evident band including a plurality of upper lips extending from a top periphery of the tamper evident band and a lower ledge extending from a bottom periphery of the tamper evident band, the lower ledge including a top surface that is integral with an angled portion and an extending protrusion, the break-away band cooperating with the tamper evident band so that the plurality of upper lips is above the break-away band, the top surface of the lower ledge is below the break-away band, the tamper evident band is laterally outward of the break-away band, and the angled portion is laterally inward of the break-away band;

wherein, when the closure is positioned onto the associated neck, the lower ledge is positioned below the associated peripheral bead and is defined by an inner dimension that is smaller than an outer dimension of the associated peripheral bead, and wherein, when the closure is removed from the associated container, the closure moves upward, a bottom surface of the peripheral bead contacts a top surface of the lower ledge extending protrusion, the peripheral bead prevents the lower ledge and the tamper evident band from moving upward, and the plurality of upper lips tears the frangible connection so that the break-away band breaks away from the closure and remains positioned between the plurality of upper lips and the lower ledge.

2. The assembly of claim 1, wherein the lower ledge further includes a crevice formed at a bottom surface of the lower ledge.

3. The assembly of claim 2, wherein the extending protrusion further includes a contacting surface that contacts the peripheral bead when the closure is being positioned onto the associated neck, the contacting surface forming an angle .theta. that is less than 90.degree. with respect to a vertical line.

4. The assembly of claim 3, wherein the contacting surface further includes a fulcrum point at about a half-way point of the contacting surface and the crevice further comprises a flexing point at an apex of the crevice, wherein the crevice biases inward about the flexing point when the closure is being slid over the peripheral bead until the fulcrum point contacts the peripheral bead, and wherein the crevice biases outward about the flexing point when the contacting surface is slid beyond the fulcrum point.

5. The assembly of claim 1, wherein the extending protrusion of the lower ledge further comprises a continuous staying ring extending laterally inward from the lower ledge, the peripheral bead preventing the staying ring from moving upward so that the tamper evident band is not removed when the closure is removed from the associated container.

6. The assembly of claim 5, wherein the lower ledge further includes a vertically extending wall and the staying ring further comprises a top surface that comprises the top surface of the extending protrusion and that forms an acute angle with the vertically extending wall.

7. The assembly of claim 1, wherein the lower ledge includes several breaks formed therein so that the lower ledge comprises a plurality of discrete lower ledge portions, and wherein the tamper evident band further comprises a plurality of lower tabs, each lower tab including a discrete lower ledge portion.

8. The assembly of claim 7, wherein each lower tab further comprises a vertically extending wall protruding from the discrete lower ledge portions, and wherein the extending protrusion of the lower ledge further comprises a continuous staying ring that extends laterally inward from the discrete lower ledge portions, the staying ring further comprising a top surface that forms an acute angle with the vertically extending walls, the peripheral bead preventing the staying ring from moving upward so that the tamper evident band is not removed when the closure is removed from the associated container.

9. The assembly of claim 8, wherein the vertically extending walls are spaced from the angled portions by intermediate portions.

10. The assembly of claim 7, wherein the extending protrusion further comprises several gaps formed therein so that the extending protrusion comprises a plurality of discrete extending protrusions, wherein each extending protrusion gap is aligned with each lower ledge break, each lower tab further comprising one of the plurality of discrete extending protrusions, each extending protrusion being defined by an inner dimension that is less than an outer dimension of the associated peripheral bead, the peripheral bead preventing the plurality of extending protrusions from moving upward so that the tamper evident band is not removed when the closure is removed from the associated container.

11. The assembly of claim 7, wherein the means for tearing further comprises a plurality of upper lips.

12. The assembly of claim 11, wherein each of said lower ledge breaks is positioned below one of the upper lips.

13. The assembly of claim 1, wherein the frangible connection extends laterally from the bottom periphery of the skirt.

14. The assembly of claim 13, wherein the break-away band extends laterally from the frangible connection.

15. The assembly of claim 13, wherein the break-away band depends from the frangible connection.

16. The assembly of claim 1, wherein the frangible connection depends from the bottom periphery of the skirt.

17. The assembly of claim 1, wherein the closure, tamper evident band and container have non-circular shapes.

18. The assembly of claim 1, wherein the closure, tamper evident band and container have circular shapes.

19. The assembly of claim 1, wherein the closure further comprises a snap-on closure.

20. A closure assembly for positioning onto an associated container having a peripheral bead on a neck of the associated container, the assembly comprising: a closure including a top and a skirt depending from a periphery of the top, the skirt including a break-away band frangibly connected to a bottom periphery of the skirt by a plurality of frangible connectors extending laterally from a central axis of the closure assembly; and, a tamper evident band that is separate from the closure, the tamper evident band including an upper lip extending from a top periphery of the tamper evident band, the break-away band being positioned below the upper lip; wherein, when the closure is positioned onto the associated neck, the lower ledge is positioned below the associated peripheral bead and is defined by an inner dimension that is smaller than an outer dimension of the associated peripheral bead, and wherein, when the closure is removed from the associated container, the closure moves upward, the peripheral bead prevents the lower ledge and the tamper evident band from moving upward, and the upper lip tears the frangible connectors so that the break-away band breaks away from the closure and remains positioned between the upper lip and the lower ledge.

21. The assembly of claim 20, wherein the lower ledge further includes a crevice formed at a bottom surface of the lower ledge.

22. The assembly of claim 21, wherein the lower ledge further includes a contacting surface that contacts the peripheral bead when the closure is being positioned onto the associated neck, the contacting surface forming an angle $\theta$ that is less than 90 with respect to a vertical line.

23. The assembly of claim 22, wherein the contacting surface further includes a fulcrum point and the crevice further comprises a flexing point at an apex of the crevice, wherein the crevice biases inward about the flexing point when the closure is being slid over the peripheral bead until the fulcrum point contacts the peripheral bead, and wherein the crevice biases outward about the flexing point when the contacting surface is slid beyond the fulcrum point.

24. The assembly of claim 20, wherein the upper lip includes several spaces formed therein so that the upper lip comprises a plurality of upper lips.

25. The assembly of claim 20, wherein the upper lip comprises a continuous upper lip.

26. The assembly of claim 20, wherein the upper lip includes an upper lip bottom surface that forms an angle $\alpha$ with a horizontal line, the angle $\alpha$ being between about $-5°$ and about $-45°$ or between about $5°$ and about $45°$.

* * * * *